US005852990A

United States Patent [19]

Primdahl

[11] Patent Number: 5,852,990

[45] **Date of Patent: *Dec. 29, 1998**

[54] WASTE HEAT BOILER

[75] Inventor: Ivar Ivarsen Primdahl, Copenhagen, Denmark

[73] Assignee: Haldor Topsoe A/S, Lyngby, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 467,544

[22] Filed: Jun. 6, 1995

[30] Foreign Application Priority Data

Jun. 29, 1994 [DK] Denmark ..... 0771/94

[51] Int. Cl.[6] ..... F22D 1/00

[52] U.S. Cl. ..... 122/7 R; 122/20 B; 137/605; 137/825

[58] Field of Search ..... 122/7 R, 20 B; 137/605, 825

[56] References Cited

U.S. PATENT DOCUMENTS

| | | | |
|---|---|---|---|
| 3,477,411 | 11/1969 | Gething | 122/7 R |
| 3,548,851 | 12/1970 | Sampson . | |
| 4,726,301 | 2/1988 | Des Ormeaux et al. | 122/20 B |
| 4,899,696 | 2/1990 | Kennedy et al. | 122/13 R |
| 4,993,367 | 2/1991 | Kehrer | 122/7 R |
| 5,029,556 | 7/1991 | Malmstrom et al. | 122/7 R |
| 5,031,692 | 7/1991 | Kehrer et al. | 122/7 R |
| 5,452,686 | 9/1995 | Stahl | 122/20 B |

FOREIGN PATENT DOCUMENTS

| | | |
|---|---|---|
| 0357907 | 3/1990 | European Pat. Off. . |
| 1196343 | 6/1970 | United Kingdom . |
| 1303092 | 1/1973 | United Kingdom . |

*Primary Examiner*—Teresa J. Walberg
*Assistant Examiner*—Jiping Lu
*Attorney, Agent, or Firm*—Ostrolenk, Faber, Gerb & Soffen, LLP

[57] ABSTRACT

A waste heat boiler for cooling a hot process stream includes a plurality of heat exchanging tubes within a cylindrical shell, an outlet chamber for withdrawing the cooled process stream, an insulated by-pass tube having an outlet end in the outlet chamber, and an injection nozzle in the outlet chamber for control of flow of the hot process stream through the by-bass tube by injection of a fluid into the by-pass tube outlet end.

2 Claims, 1 Drawing Sheet

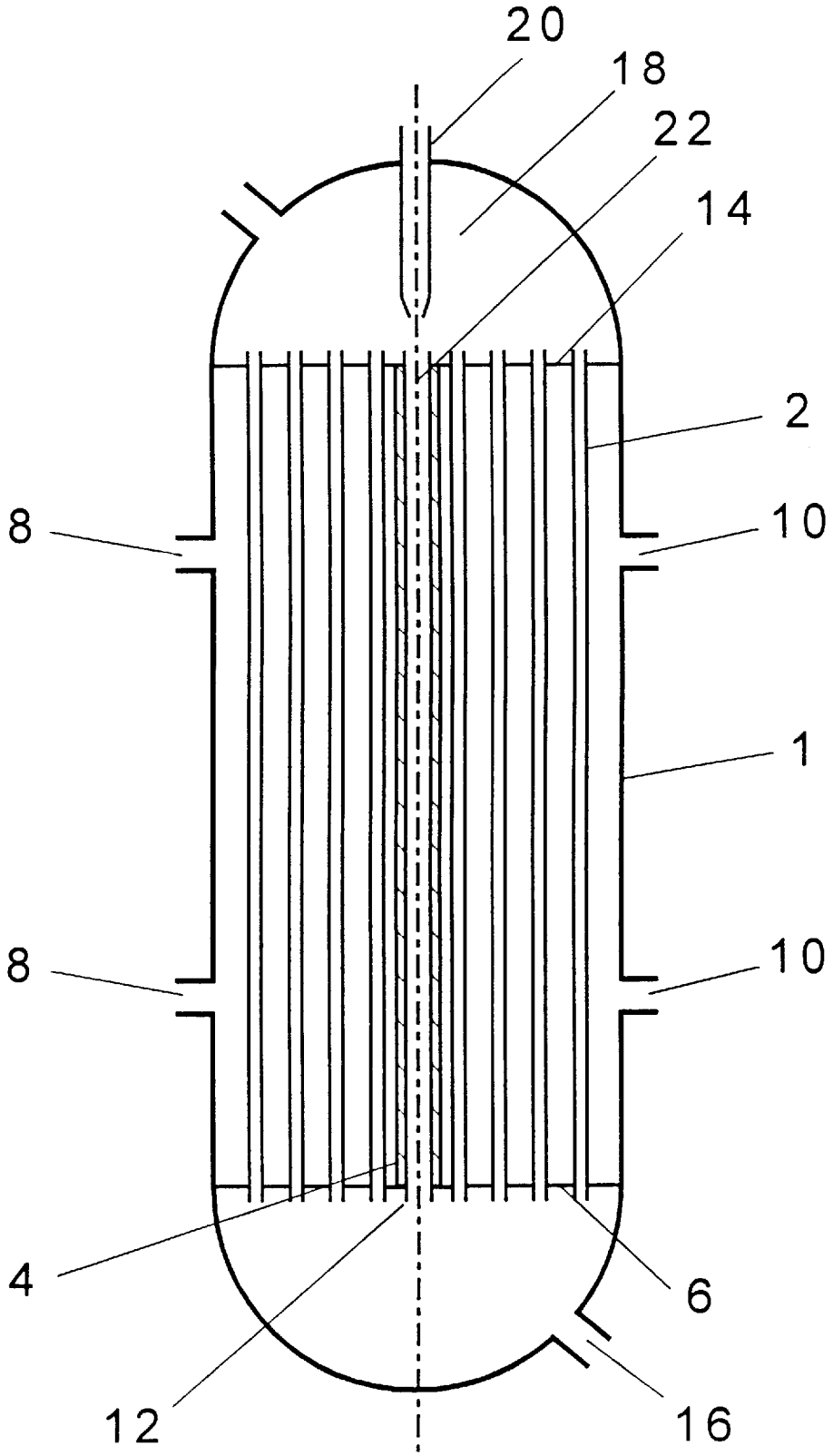
20
18
22
14
2
8
10
1
8
10
4
6
12
16

WASTE HEAT BOILER

The present invention is directed to recovery of waste heat from chemical processes. More particularly, the invention relates to a waste heat boiler with improved control of the cooling effect provided by the boiler.

Waste heat boilers are generally used for the generation of steam by waste heat recovered from hot process streams. Typically, those boilers are designed as shell-and-tube exchangers with a plurality of heat exchanging tubes arranged within a cylindrical shell.

Two basic types of shell-and-tube exchangers are employed in the industry, the watertube type, in which water/steam mixtures flow through the tubes, and the fire tube type having the heating process stream inside the tubes.

The characteristic components of boilers are tubes mounted in tubesheets at a front-end head and a rear-end head within the shell. In the firetube boilers steam, production is accomplished on the shell side of the tubes by indirect heat exchange of a hot process stream flowing through the boiler tubes. The shell side is through a number of risers and downcomers connected to a steam drum, which may be arranged at the top of the boiler shell.

The mechanical design and, in particular, dimensioning of the heat exchanging surface in shell-and-tube exchanger type boilers represent certain problems. Boiler applications involve high pressures on the shell side and considerable temperature differences between the shell and tube side. Particular considerations have to be given to fouling and corrosion characteristics of the process stream.

Boilers for handling fouling or corrosive prove process streams are usually designed to a higher duty than required in order to allow for lifetime satisfactory operation under serious fouling and corrosive conditions. The heat transferring surface of the boiler tubes is, thereby, adapted to expected corrosion and fouling factors in the stream. To provide for a desired and substantially constant cooling effect during long term operation of the boilers, appropriate heat transfer and temperature controls are required.

Conventionally designed boilers are equipped with a by-pass of a large diameter tube, which may be internal or external to the boiler shell. The by-pass is usually an insulated tube provided with a flow control valve. During initial operation of the boilers, part of the hot process stream is by-passed past the heat transferring tubes to limit the heat transfer to the required level.

After a certain length of time of operation, increase in fouling and corrosion of the tubes leads to decreased heat transfer. The amount of by-passed process stream is then reduced, which allows for higher flow of the process stream through the heat transferring tubes to maintain the required cooling effect.

A major drawback of the known boilers of the above type is vigorous corrosion on the metallic surfaces of the flow control valve, which is in contact with the uncooled process stream having temperatures as high as 1000° C.

The main object of this invention is to avoid the above drawback of the known waste heat boilers by providing a boiler of the shell-and-tube exchanger type with improved temperature control.

Accordingly, a broad embodiment of the invention is directed towards a waste heat boiler for cooling a hot process stream comprising a plurality of heat exchanging tubes within a cylindrical shell, each tube having an inlet end and outlet end;

an outlet chamber for withdrawing the cooled process stream;

attached to the shell, means for introducing water into the shell side of the tubes;

means for introducing the hot process stream into the inlet end of the tubes and passing the process stream through the tubes in indirect heat exchange with the water into shellside of the tubes to produce steam and to cool the introduced process stream;

means for withdrawing produced steam, and means for withdrawing the cooled process stream, said waste heat boiler being further equipped with an insulated by-pass tube having an outlet end being mounted in the boiler outlet chamber, the outlet chamber being provided with an injection nozzle for control of flow of the hot process stream through the by-pass tube by injection of a fluid through the nozzle into the by-pass tube outlet end.

In the above boiler, the injection nozzle is preferably installed in the outlet chamber at the centre line of the by-pass tube outlet spaced apart from the by-pass tube outlet end and having its injection muzzle directed towards the by-pass tube outlet end.

The nozzle may be made from any material being able to withstand the environment in the chamber. Useful materials are selected from metal alloys and ceramic materials.

When exposed to very high temperatures, it may be advantageous to form in the nozzle using a temperature resistant material such as refractory concrete or preformed alumina bricks protecting the nozzle surface against degradation.

By the inventive boiler design, problems in the known boilers through severe corrosion of the valves and other parts for controlling the flow of the hot process stream occurring as a result of contact with the corroding hot stream are completely avoided. As such the inventive boiler design advantageously results in a longer operation time of the boiler.

The amount of by-passed stream in the inventive boiler is adjusted by the flow of non-corroding fluid, which is injected into the bypass stream at the outlet of the by-pass tube. Consequently, the pressure at the by-pass tube outlet is controlled by the amount of the injected fluid and by the flow of the hot process stream through the by-pass tube. Thus, by proper adjustment of flow of injected fluid, it is possible to adapt the heat transfer to changes in fouling and load of the boiler without severe corrosion of control equipment.

The fluid used for controlling the flow of hot process stream in the by-pass tube may be a cooled process stream from the outlet of the boiler, steam or an inert gas such as nitrogen or a purge gas from another process unit which is cycled to the injection nozzle.

The actual kind of fluid utilized for flow control depends on the further use of the cooled process stream.

In the attached drawing, a waste heat boiler according to a specific embodiment of the invention is shown.

The boiler comprises a cylindrical shell or body 1 having thereon means 10 (usually referred to as "downcomers") for introducing water into the boiler on the shell side of heat exchanging tubes 2 and insulated by-pass tube 4 located in the boiler, and means 8 (usually referred to as "risers") for withdrawing steam produced in the boiler.

Heat exchanging tubes 2 and by-pass tube 4 are mounted in the boiler between inlet end 12 and outlet end 14 of the boiler. Inlet end 12 is connected to means 16 for introducing hot process stream into tubes 2 and 4 and outlet end 14 is provided with boiler outlet chamber 18 for withdrawing the cooled process stream from the boiler.

Outlet chamber 18 is equipped with injection nozzle 20, mounted spaced apart from outlet end of by-pass tube 4 on center line 22 of tube 4. The flow of the hot process gas stream within the tubes is from inlet end 12 through the tubes to the outlet end 14. Flow through by-pass tube 4 is controlled by injection of a fluid through nozzle 20 into the outlet end of tube 4.

By the use of steam, for example, as control fluid, the amount of steam necessary to be injected into the outlet of the by-pass tube 4 control the flow of hot process stream through the by-pass tube within a range varying from zero flow to unhindered flow is determined by the following formula:

$$\frac{\Delta p_{boiler}[\mathrm{kg/cm^2}] \cdot r^2{}_{i\ by\text{-}pass\ tube} \cdot \pi[\mathrm{cm^2}] \cdot g[\mathrm{m/sec.^2}]}{v_{flow\ of\ steam}[\mathrm{m/sec.})} \ \mathrm{kg/sec.}$$

At a boiler pressure drop Δp of 0.03 kg/cm$^2$, a by-pass tube radius r of 10 cm and a flow velocity v of injected steam of 200 m/sec., 0.46 kg steam/sec. has to be injected in order to suppress the flow of by-passed hot process stream through the by-pass tube to a value of zero.

Thus, at the above boiler parameters and conditions, the flow of hot by-passed process stream may be adjusted between zero flow and maximum flow by the injection of steam in amounts of between 0.46 and 0 kg/sec.

I claim:

1. A waste heat boiler for cooling a hot process stream comprising a plurality of heat exchanging tubes within a cylindrical shell, each tube having an inlet end and outlet end;

an outlet chamber for withdrawing the cooled process stream, said outlet end of each of the tubes being located in the outlet chamber;

attached to the shell, means for introducing water into the shell side of the tubes;

means for introducing the hot process stream into the inlet end of the tubes and passing the process stream through the tubes in indirect heat exchange with the water in the shellside of the tubes to produce steam and to cool the introduced process stream;

means for withdrawing produced steam, and means for withdrawing the cooled process stream, said waste heat boiler being further equipped with an insulated by-pass tube having an outlet end in the outlet chamber for passing a hot process stream directly into the outlet chamber such that immediately upon exiting the by-pass tube, the hot process stream mixes with the cooled process stream exiting from the outlet ends of the heat exchanging tubes, said outlet chamber being provided with an injection nozzle for control of flow of the hot process stream through the by-pass tube by injection of a fluid into the by-pass tube outlet end, said injection nozzle being installed in the outlet chamber at the center line of the by-pass tube spaced apart from the by-pass tube outlet end and having an injection muzzle directed towards the outlet end of the by-pass tube.

2. The waste heat boiler of claim 1, wherein the injection nozzle is built of temperature resistant material.

* * * * *